United States Patent [19]

Arnold et al.

[11] Patent Number: 4,956,668

[45] Date of Patent: Sep. 11, 1990

[54] DEVELOPER MIX MONITORING FOR REPLACEABLE DEVELOPER STATIONS

[75] Inventors: Kenneth A. Arnold; Wunan Chang, both of Rochester; Kelly S. Robinson, Fairport, all of N.Y.

[73] Assignee: Eastman Kodak Company, Rochester, N.Y.

[21] Appl. No.: 214,967

[22] Filed: Jul. 5, 1988

[51] Int. Cl.[5] ..... G03G 15/08

[52] U.S. Cl. ..... 355/208; 118/689; 355/245; 355/260

[58] Field of Search ..... 118/688, 689, 690, 691, 118/693; 355/14 D, 208, 245, 246, 260

[56] References Cited

U.S. PATENT DOCUMENTS

| | | | |
|---|---|---|---|
| 4,155,638 | 5/1979 | Blitzer . | |
| 4,551,000 | 11/1985 | Kanemitsu et al. | 355/3 R |
| 4,607,941 | 8/1986 | Honda | 355/3 R |
| 4,671,646 | 6/1987 | Florack et al. . | |
| 4,674,790 | 8/1987 | Watashi | 355/14 D X |
| 4,699,494 | 10/1987 | Honda | 355/3 R |
| 4,707,748 | 11/1987 | Ohtsuka et al. | 355/3 DR |
| 4,708,458 | 11/1987 | Ueda et al. | 355/14 D X |
| 4,711,555 | 12/1987 | Toshimitsu et al. | 355/14 D X |
| 4,742,370 | 5/1988 | Murakami et al. | 355/14 D X |

FOREIGN PATENT DOCUMENTS

| | | |
|---|---|---|
| 0302415 | 2/1989 | European Pat. Off. . |
| 3428587 | 2/1985 | Fed. Rep. of Germany . |
| 62-43311 | 11/1987 | Japan . |

OTHER PUBLICATIONS

JP, 60-250372(A) (Canon K.K.), Dec. 11, 1985.

*Primary Examiner*—Fred L. Braun
*Assistant Examiner*—Robert Beatty
*Attorney, Agent, or Firm*—Milton S. Sales

[57] ABSTRACT

A toner monitor in an electrostatographic machine is automatically calibrated when a new replaceable development station is loaded into the machine. The detected toner concentration in the development station is used by the monitor as a reference signal against which future readings are compared. The reference signal is reset upon machine power-up to correspond to the detected toner concentration in the development station, but only when there is a fresh development station in the machine. Resetting the reference signal only when there is a fresh development station prevents erroneous reference signals which would result if the developer mix concentration was other than perfect at power-down.

13 Claims, 5 Drawing Sheets

11
114
20
36
24
125
14
110
80
84
84
46
44
124
116
112
82
40
50
52
30
54
48
42
38a
18
13
10
38
22
16
26

58
52
50
72
74
62
10
48
13
14
46
54
52
70
56
60
68

126
128

DEVELOPER MIX MONITORING FOR REPLACEABLE DEVELOPER STATIONS

CROSS REFERENCE TO RELATED APPLICATIONS

This application is related to U.S. patent applications Ser. No. 116,200, now U.S. Pat. No. 4,747,704, filed in the names of L. A. Hill et al on Nov. 3, 1987 and Ser. No. 215,971, filed in the names of K. Robinson, L. Hill, and K. Arnold concurrently herewith.

BACKGROUND OF THE INVENTION

1. Field of the Invention

This invention relates generally to developer mix monitors for electrostatographic machines, and more particularly to automatic monitors for replaceable development stations.

2. Description of the Prior Art

Electrostatographic machines generally use a two-component developer mix comprising a toner powder and a magnetizable carrier material. During the use of the apparatus, toner powder has to be replenished in a quantity necessary to compensate for the consumption of toner powder used for the development of images. Various automatic toner replenishment systems are known wherein a signal representative of the detected concentration of toner powder in the developer mix is compared with a reference signal corresponding to a predetermined reference toner concentration. When the detected concentration is lower than the reference concentration, replenishment occurs.

The reference signal is fixed during manufacture, but re-setting in the field is often necessary when the developer mix is changed. U.S. Pat. No. 4,708,458, which issued to Ueda et al on Nov. 24, 1987, discloses a system which, when activated at the time of replacement of the used developer mix with new mix, resets the reference signal. Thereafter, the signal representative of the detected concentration is compared to the reset reference signal.

In some copiers and printers, entire development stations are replaceable when its original supply of toner is exhausted. Commonly assigned U.S. patent application Ser. No. 116,200, now U.S. Pat. No. 4,797,704 filed in the names of L. A. Hill et al on Nov. 3, 1987, discloses a disposable (and therefore replaceable) development station which is completely sealed after being loaded with developer and toner materials. Accordingly, the useful life of the station is determined by the single supply of toner power therein.

While the system of previously-mentioned U.S. Pat. No. 4,708,458 for resetting the reference signal at the time of change of the developer mix would be useful with replaceable development stations such as taught by application Ser. No. 116,200, now U.S. Pat. No. 4,797,709 there would exist a risk that an operator would forget to activate the resetting system. This would result in a false reference signal set to the previous development station characteristics.

SUMMARY OF THE INVENTION

A toner monitor in an electrostatographic machine is automatically calibrated when a new replaceable development station is loaded into the machine. The detected toner concentration in the development station is used by the monitor as a reference signal against which future readings are compared. The reference signal is reset upon machine power-up to correspond to the detected toner concentration in the development station, but only when there is a fresh development station in the machine. Resetting the reference signal only when there is a fresh development station prevents erroneous reference signals which would result if the developer mix concentration was other than perfect at power-down To assure that the reference signal is reset automatically, while preventing resetting the reference signal unless a fresh development station is in use, the present invention provides means for sensing when the reference value has previously been set for a given development station, whereby the reference value would not be reset upon other than the first time the machine is powered up with a particular development station.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
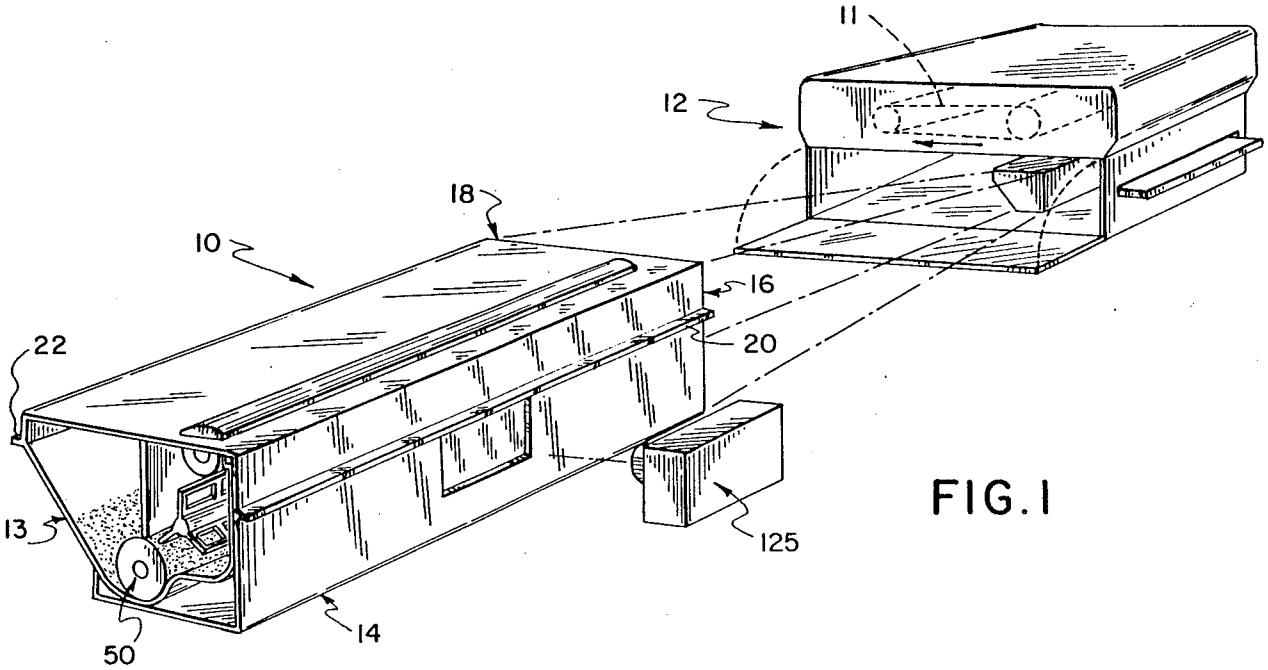
FIG. 1 is a perspective view of a preferred embodiment of a replaceable development station and of an electrostatographic machine of the present invention.
Figure 2:
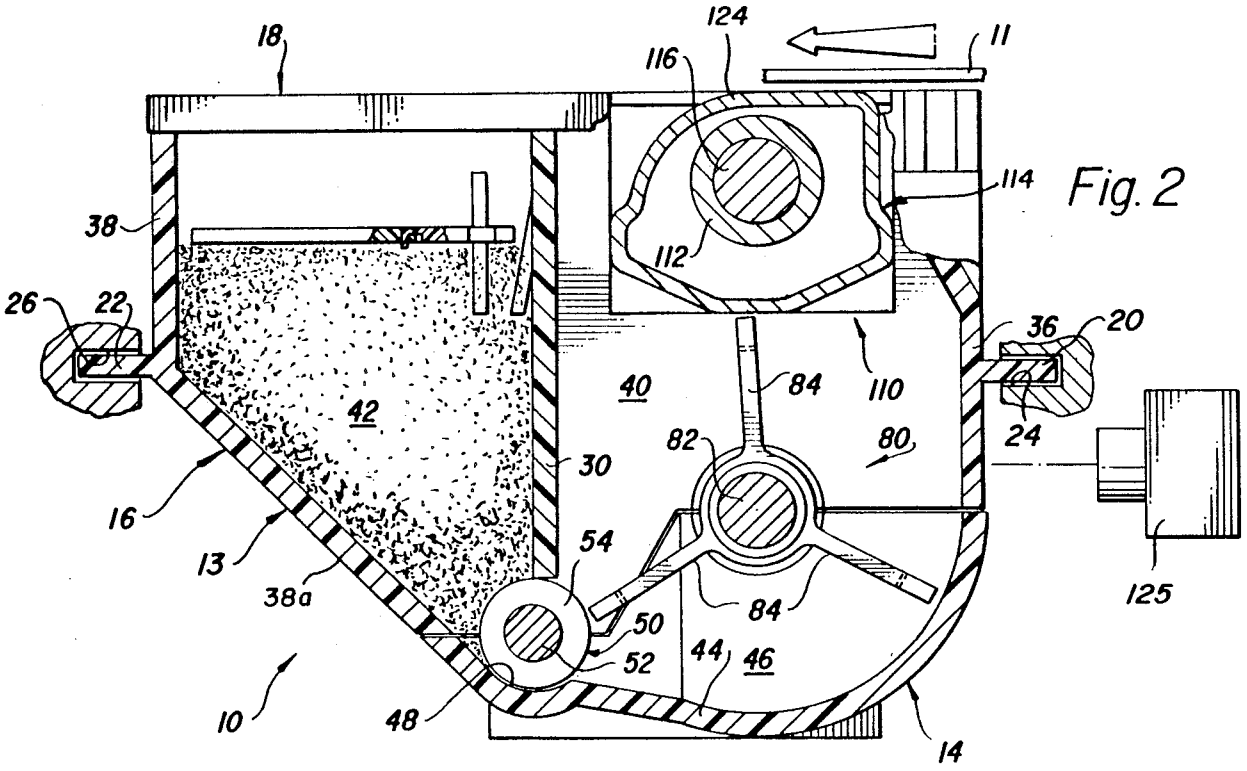
FIG. 2 is a transverse cross-section of the station shown in FIG. 1.

Referring now to FIGS. 1 and 2 of the drawings, a replaceable development station is generally designated 10. It can be used to develop latent electrostatic images on a photoconductor 11 of an electrostatographic machine according to the present invention, such as a copier or printer 12, as the photoconductor is driven past the development station in the direction indicated by the arrow. Station 10 comprises an elongate housing 13 that is assembled from three housing parts 14, 16 and 18 that extend the full length of the station.

The housing preferably has suitable guides for facilitating location of the station in a copier or printer. For example, center housing part 16 can have a pair of longitudinally extending and asymmetrically positioned guides 20 and 22 along its opposite side edges. These guides are shown received in slots 24 and 26, respectively, in copier or printer 12 as station 10 is loaded into the copier or printer.

Center housing part 16 has a vertically oriented wall 30 that extends the full length of the housing and is spaced from each of a pair of side walls 36 and 38 of the center housing part. The top edge of wall 30 is closely adjacent the inner surface of top housing part 18, and the lower edge of wall 30 is spaced from the inner surface of bottom part 14. Wall 30 divides the housing into two separate chambers 40 and 42 positioned in side-by-side relationship with the space beneath wall 30 providing access between the chambers. Chamber 40 is adapted to receive a two-component developer mix comprising carrier magnetizable particles and toner powder that are to be furnished to latent images on photoconductor 11. Chamber 42, on the other hand, holds a supply of fresh toner powder. As described later, toner powder is periodically metered from chamber 42 to chamber 40 to maintain the desired toner concentration in the developer mix.

Wall 38 of center housing part 16 includes a lower portion 38*a* that extends from approximately guide 22 to the lower end of housing part 16 and merges with a bottom wall 44 of bottom housing part 14. Wall portion 38*a* is slanted downwardly and inwardly at a relatively steep angle. This slanted or tapered wall portion 38*a* facilitates the flow of toner powder from the upper portion of chamber 42 downwardly toward wall 30, thus avoiding the formation of areas where toner powder can be deposited or remain in clumps.

Bottom wall 44 of bottom housing part 14 defines a sump 46 for a supply of developer mix. Wall 44 includes an elongate semi-cylindrical recess 48 that is located generally below and spaced from the lower end of vertical wall 30 in housing part 16. Thus the recess in wall 44 and the lower end of wall 30 define a passageway providing access for fresh toner powder to be delivered from chamber 42 to chamber 40.

Figures 3, 4:
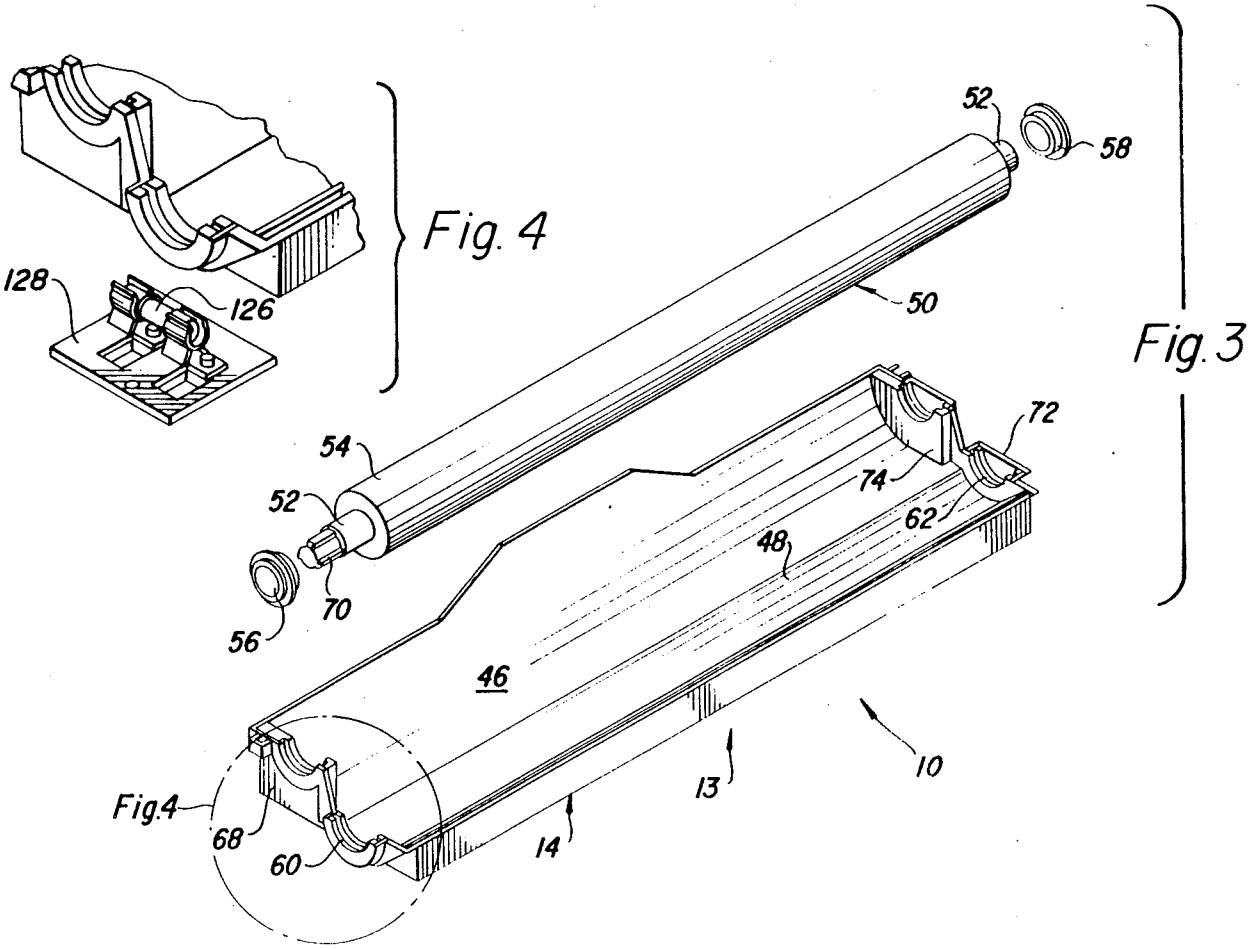
FIG. 3 is a perspective view illustrating a portion of the station shown in FIGS. 1 and 2.
FIG. 4 is an enlargement of a region of the portion of the station shown in FIG. 3, and also showing an electrical fuse module and fuse.

A toner dispensing roller 50 is positioned in the passageway between the lower end of wall 30 and recess 48 in wall 44 and substantially fills that passageway. Referring to FIG. 3, dispensing roller 50 comprises an elongate cylindrical shaft 52 that is covered with a cylindrical layer of foam material 54 with the outer circumference of the foam layer being in contact with the lower end of wall 30 and the surface of recess 48 in wall 44.

The ends of shaft 52 project beyond the ends of foam covering 54. Bearings 56 and 58 fit over the ends of shaft 52. Recesses 60 and 62 in bottom housing part 14 have slots that receive annular flanges on the bearings to locate the bearings in the housing.

The end of shaft 52 shown at the left in FIG. 3 projects through recess 60 in an end wall 68 of the bottom housing part. This projecting end portion of the shaft has gear teeth 70 that are engaged by a drive mechanism (not shown) inside copier or printer 12 when the station is fully inserted into the copier or printer. On the other end of the housing, a cover 72 of generally semi-cylindrical shape projects from end wall 74 of bottom housing part 14 and encloses the lower half of shaft 52 located in recess 62. The end of shaft 52 is not exposed at the right or front end of the development station to prevent inadvertent contact by the operator of rotating shaft 52.

Referring back to FIG. 2, the developer mix in chamber 40 comprises carrier particles and toner powder which need to be mixed together to triboelectrically charge the particles before they are applied to a latent image on photoconductor 11. Accordingly, a mixing wheel generally designated 80 is provided in chamber 40. The mixing wheel comprises an elongate shaft 82 and a plurality of mixing blades or paddles 84 that are secured to the shaft and project radially outwardly therefrom. Three such blades 84 are illustrated in the drawings positioned at 120 degree intervals about the axis of shaft 82. Blades 84 will lift some of the developer mix and move it vertically in chamber 40 to a developer applicator generally designated 110.

A preferred embodiment of the applicator 110 comprises a magnetic brush having a rotatable magnetic roller 112 positioned within a stationary shell 114. The magnetic roller 112 can be of a conventional construction comprising a plurality of magnetic poles that extend longitudinally along a shaft 116 with alternate poles in a circumferential direction comprising north and south poles. Rotation of the magnetic roller 112 in a clockwise direction as viewed in FIG. 2 feeds developer mix upwardly to photoconductor 11.

When the station is loaded into copier or printer 12, the drives for dispensing roller 50, mixing wheel 80 and applicator 110 are automatically engaged with suitable drives in the copier or printer. Mixing wheel 80 and magnetic roller 112 are constantly driven when developer mix is to be provided to the photoconductor. As the mixing wheel sweeps through sump portion 46 of chamber 40 it mixes the developer mix in that chamber and triboelectrically charges the carrier particles and toner powder. The mixing wheel also delivers some of the toner mix to applicator 110, and the mix is magnetically held to the applicator by the magnets of roller 112. As roller 112 is rotated, the developer mix travels upwardly and then along wall 124 so that toner powder can contact the Photoconductor as it moves past the development station for developing the latent images. When the concentration of toner in chamber 40 reaches a predetermined low level as determined by a toner concentration monitor 125, shaft 52 of dispensing roller 50 is driven to provide new toner from chamber 42 into sump 46 for mixing with toner-depleted carrier particles. When the entire initial toner supply has been depleted, the station is easily removed and disposed of, and a fresh station is placed in copier or printer 12.

Further details of the disposable development station can be found in commonly assigned, co-pending U.S. patent application Ser. No. 116,200 filed Nov. 3, 1987 now U.S. Pat. No. 4,797,704. The disclosure of that application is specifically incorporated by reference herein.

Referring to FIG. 4, a fuse 126 is clipped into a module 128 and mounted to bottom housing part 14, preferably be sonic welding. Electrical contacts on the bottom side of the module provide electrical access to the fuse.

The toner monitor and replenishment control will be described with respect to FIG. 5. This control circuit includes a central processor unit 130 and toner monitor 125 for detection of the toner concentration within chamber 40 of development station 10. Toner monitor 125 may be chosen from several commercially available produces, such as, for example, those responsive to changes in effective permeability of two component developers and manufactured by Hitachi Metals, Ltd. Toner monitor 125 emits an analog signal which is representative of the permeability in the developer mix, and thus representative of the toner concentration. The signal is digitized at an analog-to-digital converter 132 and inputted to a port of central processing unit 130.

Central processing unit 130 has an output port connected to a toner replenishment motor 134. The toner replenishing motor is used to drive toner dispensing roller 50 (FIG. 2) in accordance with a suitable algorithm which compares the toner concentration signal from analog-to-digital converter 132 to a reference signal corresponding to a predetermined reference toner concentration. The reference value is stored in memory in central processing unit 130. When the detected concentration is lower than the reference concentration, the replenishment motor is activated.

When a replacement development station 10 is first installed, its developer mix has been preadjusted to the Proper concentration by the manufacturer. Accordingly, the toner concentration then detected by monitor 125 represents the ideal reference concentration. Therefore, it is highly desirable that the toner concentration signal produced during the first power-up immediately after replacement of a development station be stored in RAM in central processing unit 130 and thereafter used as the reference signal.

Resetting the reference value each time the machine is powered up could result in a reference value other than ideal. For example, one might turn the machine off after some toner depletion has occurred, but before a replenishment cycle has been effected. Upon power-up, the reference value would be changed to the lower concentration value then detected. Likewise, if the machine is turned off immediately after a replenishment, the reference value would likely be too high if it were reset in conjunction with the next power-up.

Accordingly, means are provided for marking the development station in a manner sensable by the machine to indicate that the station has previously been used. The machine senses the marking means and enables the recalibration process only if a fresh development station is in use.

The preferred marking mean includes frangible electrical fuse 126 mounted on the development station, preferably in an inaccessible position to inhibit replacement of a blown fuse. A small voltage, of say 5 volts DC, is connected to one side 142 of the fuse. If the voltage is sensed upon power-up at a port 144 of the central processing unit, the developer station is considered to be fresh. The central processing unit turns on a transistor 146 to essentially connect the fuse to ground; increasing the current beyond the rating of the fuse (100 mA in the example) and blowing the fuse. The time to open the fuse is roughly ten seconds in the example. During this period, the central processing unit runs background functions, including calculation of a new reference signal corresponding to the detected toner concentration.

On the other hand, if no voltage is sensed at port 144 upon power-up, the developer station is considered to be previously used. In that event, the reference signal value already stored in the central processing unit RAM is retained and used in replenishment calculations.

Figure 6:
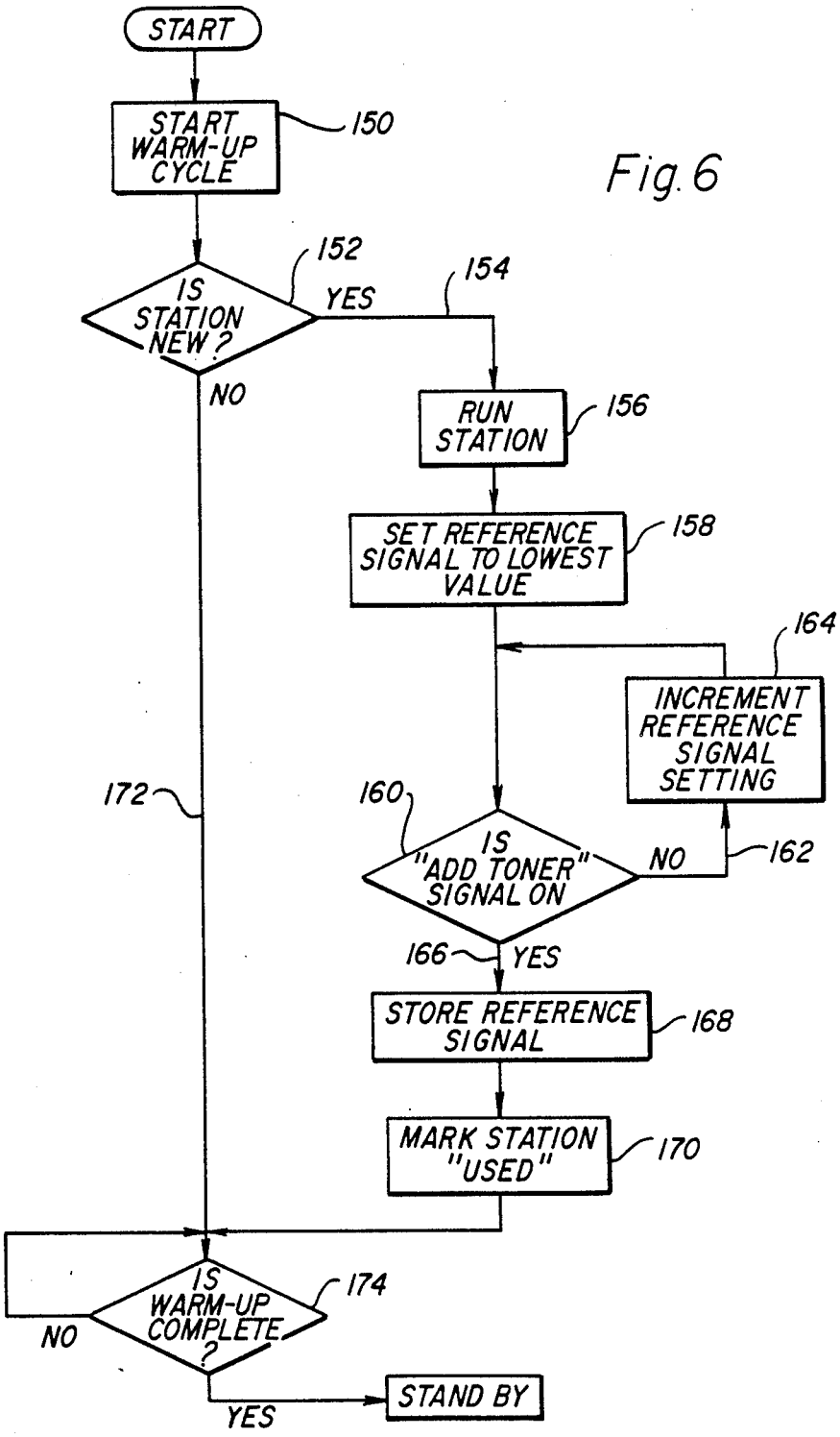
FIG. 6 is a logic Flowchart of the process by which the architecture of FIG. 5 operates.

FIG. 6 is a logic flowchart outlining the steps to be followed for resetting the concentration reference signal. A conventional microprocessor, a programmable logic array, or discrete logic could be implemented to perform the functions shown in the flowchart.

Figure 5:
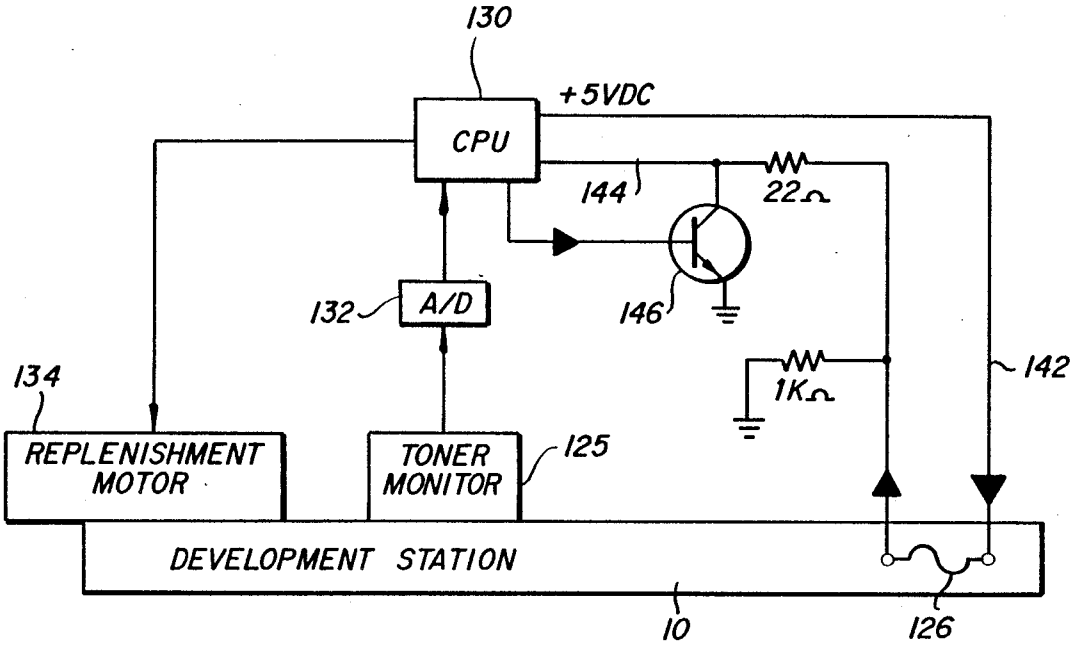
FIG. 5 is a block diagram showing control architecture for monitoring the development station of FIGS. 1–4.

At power-up, the algorithm of FIG. 5 passes through a connector block 150 initiating a machine warm-up cycle, and enters into a decisional block 152. In block 152, the logic tests the development station to determine if it is fresh. If so, the logic exits the decisional block along a path 154 into a functional block 156 to begin running the development station.

When the development station is running, the logic sets the reference signal at its lowest value (functional block 158) and tests it against the signal representative of the detected toner concentration (decisional block 160). If the decision from block 160 indicates that the reference concentration is lower than the detected concentration, the logic exits the decisional block along a path 162 into a function block 164 to increment the reference signal value setting.

If the decision from decisional block 160 was "yes" instead of "no" (the toner concentration was less than the reference toner concentration), the logic exits block 160 along a path 166 into a decisional block 168. In block 168, the reference value is stored for future use. The development station is them marked as "used," such as by blowing fuse 126, at function block 170.

If the decision from block 152 was "no" instead of "yes" (the station had previously been used and was not new), then the logic exits block 152 along a path 172 into a decisional block 174 which cycles until the machine is warmed up.

The invention has been described in detail with particular reference to preferred embodiments thereof, but it will be understood that variations and modifications can be effected within the spirit and scope of the invention.

What is claimed is:

1. An electrostatographic machine comprising:

means for receiving replaceable development stations of the type having (1) a chamber containing a developer mix of carrier particles and toner powder in a predetermined desired concentration and (2) means for indicating whether the developer mix in the development station is fresh;

means for producing a signal representative of the concentration of toner powder in the developer mix in the chamber;

means for setting a reference signal;

means for sensing the indicating means of a received development station for determining if the development mix therein is fresh; and means, operable only upon determining that the developer mix in the received development is fresh, for adjusting the reference signal until it substantially equals the toner concentration signal.

2. An electrostatographic machine as set forth in claim 1 wherein said means for adjusting the reference signal is operable only upon power-up of said electrostatographic machine.

3. An electrostatographic machine as set forth in claim 1 wherein said development station is disposable.

4. An electrostatographic machine as set forth in claim 1 further comprising means for adjusting the indicating means of a received development station upon power-up of the machine to indicate that the developer mix therein is not fresh.

5. An electrostatographic machine comprising:

means for receiving replaceable development stations of the type having (1) a first chamber containing a developer mix of carrier particles and toner powder in a predetermined desired concentration, (2) a second chamber for a supply of toner powder to be delivered to the first chamber to maintain the predetermined concentration of toner powder in the developer mix, (3) feed means for delivering toner powder from the second chamber to the first chamber; and (4) means for indicating whether the developer mix in the first chamber is fresh;

means for producing a signal representative of the concentration of toner powder in the developer mix in the chamber;

means for setting a reference signal;

means for sensing the indicating means of a received development station for determining if the development mix therein is fresh;

means, operable only upon determining that the developer mix in the received development is fresh, for adjusting the reference signal until it substantially equals the toner concentration signal; and means for comparing the reference signal and the toner concentration signal and for operating the feed means when the difference between the reference and concentration signals reaches a predetermined threshold.

6. An electrostatographic machine as set forth in claim 5 wherein said means for adjusting the reference signal is operable only upon power-up of said electrostatographic machine.

7. An electrostatographic machine as set forth in claim 5 wherein said development station is disposable.

8. An electrostatographic machine comprising:

means for receiving replaceable development stations of the type having (1) a chamber containing a developer mix of carrier particles and toner powder in a predetermined desired concentration and (2) frangible means for indicating whether the developer mix in the development station is fresh;

means for producing a signal representative of the concentration of toner powder in the developer mix in the chamber;

means for setting a reference signal;

means for sensing the frangible means of a received development station for determining if the development mix therein is fresh; and means, operable only upon determining that the developer mix in the received development station is fresh, for adjusting the reference signal until it substantially equals the toner concentration signal.

9. An electrostatographic machine as set forth in claim 8 wherein said means for adjusting the reference signal is operable only upon power-up of said electrostatographic machine.

10. An electrostatographic machine as set forth in claim 8 further comprising means for breaking the frangible means in a received development station upon power-up of the machine.

11. An electrostatographic machine comprising:

means for receiving replaceable development stations of the type having (1) a chamber containing a developer mix of carrier particles and toner powder in a predetermined desired concentration and (2) an electrical fuse;

means for producing a signal representative of the concentration of toner powder in the developer mix in the chamber;

means for setting a reference signal;

an electrical circuit connectable to the fuse of a received development station for determining if the fuse is blown; and means, operable only upon determining that the fuse in a received development station is not blown, for adjusting the reference signal until it substantially equals the toner concentration signal.

12. An electrostatographic machine as set forth in claim 11 wherein said means for adjusting the reference signal is operable only upon power-up of said electrostatographic machine.

13. An electrostatographic machine as set forth in claim 11 further comprising means for blowing the fuse in a received development station upon power-up of the machine.

* * * * *